US005181708A

United States Patent [19]

Ruch

[11] Patent Number: 5,181,708

[45] Date of Patent: Jan. 26, 1993

[54] METHOD AND APPARATUS FOR SELECTING A SINGLE SHEET OF PAPER FROM A PAPER TRAY

[75] Inventor: Mark H. Ruch, Spring, Tex.

[73] Assignee: Compaq Computer Corporation, Houston, Tex.

[21] Appl. No.: 556,944

[22] Filed: Jul. 20, 1990

[51] Int. Cl.[5] ..... B65H 3/00

[52] U.S. Cl. ..... 271/21; 271/118; 271/121

[58] Field of Search ..... 271/19, 21, 117, 118, 271/121, 122, 125, 161, 167, 169

[56] References Cited

U.S. PATENT DOCUMENTS

| | | | |
|---|---|---|---|
| 3,279,787 | 10/1966 | Niccoli | 271/21 |
| 3,866,901 | 2/1975 | Brock | 271/21 |
| 3,893,663 | 7/1975 | Sanchez et al. | 271/21 |
| 3,940,125 | 2/1976 | Morton | 271/21 |
| 4,223,884 | 9/1980 | Burnham et al. | 271/21 |
| 4,463,943 | 8/1984 | Deconinck | 271/21 |
| 4,506,876 | 3/1985 | Nishibori | 271/167 |

FOREIGN PATENT DOCUMENTS

| | | | |
|---|---|---|---|
| 383922 | 5/1965 | Fed. Rep. of Germany | 271/118 |
| 932551 | 7/1963 | United Kingdom | 271/21 |
| 988552 | 4/1965 | United Kingdom | 271/21 |
| 1455999 | 11/1976 | United Kingdom | 271/21 |

*Primary Examiner*—Robert P. Olszewski
*Assistant Examiner*—Steven M. Reiss
*Attorney, Agent, or Firm*—Konneker & Bush

[57] ABSTRACT

The top sheet is separated and removed from a paper sheet stack by a paper feed mechanism which is selectively movable downwardly toward the stack. As the feed mechanism downwardly approaches the stack, a foot portion of the mechanism frictionally contacts the top sheet and is upwardly pivoted by the stationary paper stack. Upward pivoting of the foot portion causes it to frictionally shift the top sheet in a first horizontal direction relative to the rest of the sheets. A drive wheel portion of the feed mechanism, supported for conjoint pivoting with the foot portion about its pivot axis, then frictionally engages the shifted top sheet in place of the foot portion. In response to the upward pivoting of the foot portion, a driven gear supported for pivotal movement therewith and rotationally locked to the drive wheel portion is caused to mesh with a drive gear operative to rotate the driven gear and thus the drive wheel portion. Rotation of the drive wheel portion frictionally drives the shifted top sheet, over a ramp-shaped portion of the feed mechanism, in a horizontal direction opposite to the initial shift direction thereof to thereby separate and remove the top sheet from the paper stack.

18 Claims, 7 Drawing Sheets

METHOD AND APPARATUS FOR SELECTING A SINGLE SHEET OF PAPER FROM A PAPER TRAY

BACKGROUND OF THE INVENTION

1. Field of the Invention

This invention relates generally to a method and apparatus for selectively feeding sheets of paper to a printer, a copier, or the like, and, more particularly, to a method and apparatus for selectively engaging multiple stacks of paper and feeding single sheets from the selected stack of paper to a printer, a copier, or the like.

2. Description of the Related Art

In the field of printers, paper handling mechanisms typically employ a separate sheet feeding mechanism for each tray of paper that the printer has the ability to access. Each pair of trays and sheet feeding mechanisms are normally stacked in a vertical arrangement and consume vertical space equal to the height of each tray and the height of each sheet feeding mechanism. Accordingly, the vertical height of each tray and sheet feeding mechanism limits the maximum number of trays that can be associated with a paper handling mechanism if a printer is to be used in a desktop environment.

In eleotrophotographic printers, such as desktop laser printers, these trays typically are configured to hold approximately 250 sheets of paper. The trays include a bottom portion that supports the stack of paper. The bottom portion is hinged, and a spring acts against the bottom portion to pivot the bottom portion upwardly. Thus, the stack of paper pivots upwardly against the stationary sheet feeding mechanism associated with that tray.

Since the spring force constantly maintains the paper in contact with the sheet feeding mechanism, paper cannot be added to the tray unless the tray is removed. Thus, the printing process from that tray must cease while the tray is removed to replenish the paper supply. In addition, the printing process from that tray must cease when the user wishes to print a short run of unique paper that differs from the paper currently in the tray.

To overcome this inherent deficiency, previous laser printers have employed a sheet feeding mechanism that allows a user to singularly and consecutively feed a small number of sheets into the printer. Of course, this process does not free the user to accomplish other tasks, but requires that the user remain at the printer, consecutively feeding each sheet of paper until the entire printing process is completed. Alternatively, the user may remove the tray from the paper handling mechanism insert the desired number of sheets of paper into the tray and replace the tray into the paper handling mechanism. While this method does free the user to leave the printer during the printing process, the procedure of removing and loading the tray slows the printing process.

Another problem arises due to a pressure variation between the sheet feeding mechanism and the stack of paper. The pressure varies with the thickness of the stack of paper remaining in the tray, because the force applied by the spring is dependent upon the degree of compression of the spring, which is nonlinear. This pressure variation can cause the sheet feeding mechanism to occasionally misfeed a sheet of paper.

Typically, laser printers insure that a single sheet is selected from the stack of paper in the tray by employing a "corner buckler." A corner buckler is a small tab of metal that is placed in one corner of each tray. The sheet feeding mechanism contacts the top sheet of paper in the tray, and moves the sheet toward the corner buckler. As the sheet leaves the tray, the corner buckler deforms the corner of the top sheet of paper to separate it from any lower sheets. However, if two sheets of paper are stuck together and moving out of the tray, occasionally the deformation produced by the corner buckler will not be sufficient to separate these sheets from one another. Moreover, the corner buckler limits the speed at which paper may be removed from the tray.

Since the market for desktop printers is highly competitive extremely cost sensitive, any proposed solution to these problems, or other advances in printer technology, should be economical, durable, and easy to manufacture and repair.

The present invention is directed to overcoming, or at least minimizing, one or more of the problems as set forth above.

SUMMARY OF THE INVENTION

In accordance with one aspect of the present invention, a method of removing a sheet from a stack of sheets is provided in which a selected sheet on the stack is contacted and separated from the stack. The unselected sheets on the stack are compressed to prevent movement of the unselected sheets. Then, the selected sheet is removed from the stack while the unselected sheets are being held. Since the unselected sheets are held while the selected sheet is removed, the selected sheet is reliably removed without its deformation.

In accordance with another aspect of the present invention, a method of removing a sheet from a stack of sheets is provided in which a selected sheet on the stack is contacted and moved in a first direction to separate the selected sheet from the stack. The selected sheet is then removed from the stack by moving the selected sheet in a second direction opposite the first direction. Since the selected sheet is moved in opposite directions, it can be removed from the stack with less likelihood of sticking to another sheet.

In accordance with a further aspect of the present invention, a sheet-feeding mechanism for removing a sheet from a stack of sheets is provided. The mechanism is adapted to move along a preselected vertical path. The mechanism includes a rotatable drive shaft having a drive gear disposed thereon for rotation therewith, and a rotatable driven shaft having a driven gear disposed thereon for rotation therewith. A means allows the driven shaft to pivot relative to the drive shaft to engage and disengage the drive gear with the driven gear so that the drive shaft can selectively drive the driven shaft. A means moves a selected sheet on the stack in a first direction to separate the selected sheet from the stack in response to the mechanism moving downward along the path and in response to the driven shaft pivoting upwardly. A means prevents movement of unselected sheets of paper within the stack. A wheel is rotatably disposed on the driven shaft. The wheel is disposed to contact the selected sheet and remove it from the stack of sheets in response to the driven shaft pivoting to engage the gears.

More specifically, a foot is adapted to pivot the driven shaft relative to the drive shaft. The foot is adapted to contact a top sheet in a stack of sheets positioned in the vertical path as the mechanism moves vertically downward toward the stack of sheets. The contact causes the foot to pivot the driven shaft toward the drive shaft, and, thus, separates the top sheet from the stack of sheets as it pivots. The wheel is disposed relative to the foot to contact top sheet as the foot pivots out of contact with the top sheet in response to the driven shaft pivoting to engage with the drive shaft. The resulting rotation of the wheel removes the top sheet from the stack of sheets.

BRIEF DESCRIPTION OF THE DRAWINGS

Advantages of the invention will become apparent upon reading the following detailed description and upon reference to the drawings in which.

Figure 1:
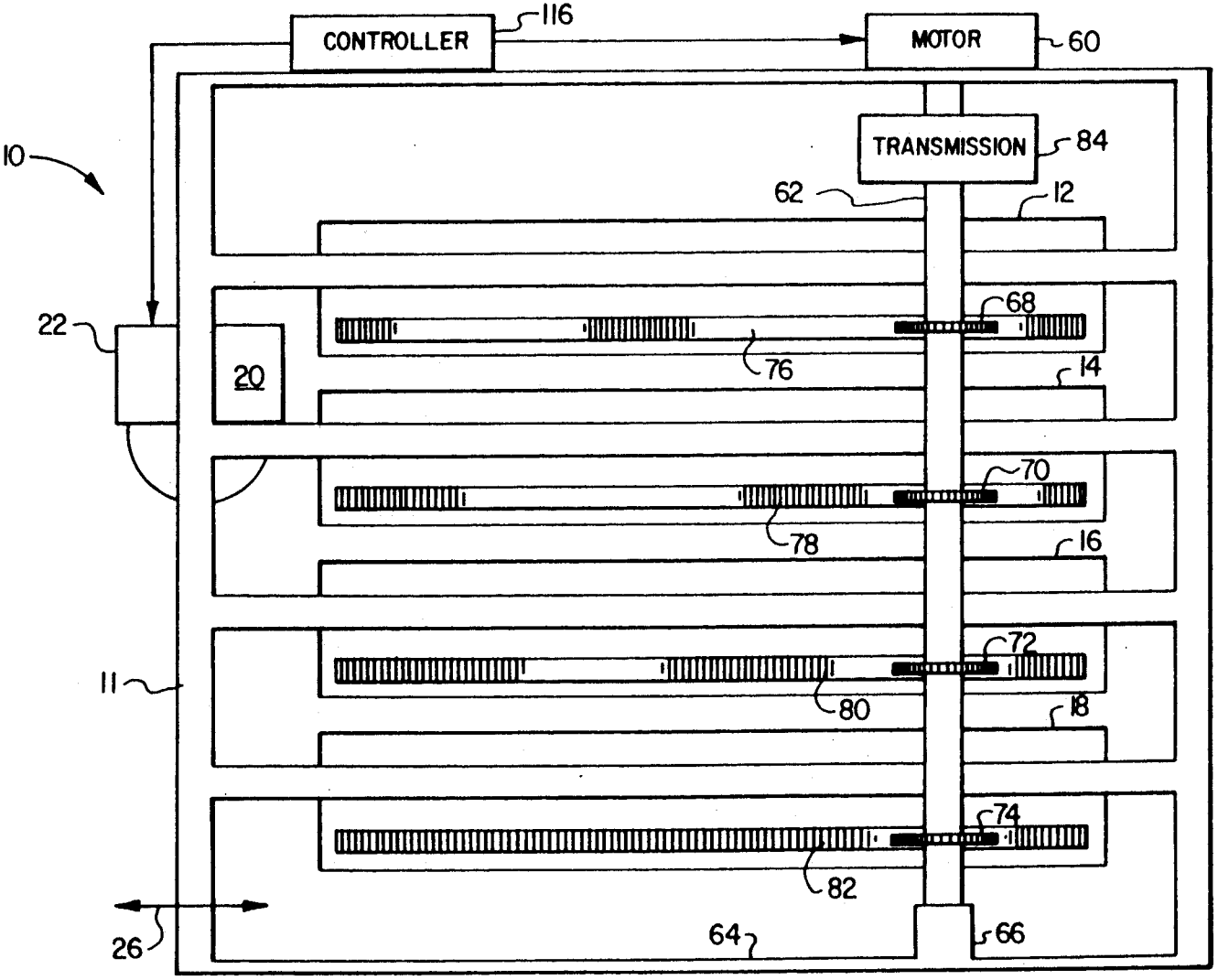
FIG. 1 is a conceptual schematic diagram of a paper handling apparatus in accordance with the present invention.

While the invention is susceptible to various modifications and alternative forms, specific embodiments have been shown by way of example in the drawings and will be described in detail herein. However, it should be understood that the invention is not intended to be limited to the particular forms disclosed. Rather, the invention is to cover all modifications, equivalents, and alternatives falling within the spirit and scope of the invention as defined by the appended claims.

DESCRIPTION OF THE PREFERRED EMBODIMENTS

Turning to the drawings and referring first to FIG. 1, a side view of a paper handling mechanism 10 for a printer or copier (not shown) is illustrated. While the discussion of the mechanism 10 is primarily confined to its combination with an electrophotographic desktop printer, it is readily envisioned that the mechanism 10 may be combined with various types and styles of printers or copiers without departing from the spirit and scope of the present invention.

The mechanism 10 includes a frame 11 that houses a plurality of paper containing trays 12, 14, 16, and 18. The trays 12, 14, 16 and 18 are slidably disposed within the frame 11 as will be explained in detail with respect to FIG. 2. For ease of illustration, the trays 12, 14, 16 and 18 are illustrated as being the same size, but in actuality the trays 12, 14, 16 and 18 would normally be sized to accept different types and sizes of paper. Preferably, each tray 12, 14, 16, and 18 contains a different style of paper, so that when a user selects the desired style of paper, the printer automatically selects the proper tray 12, 14, 16 or 18. For example, it might be desireable to load each of the trays 12, 14, 16 and 18 with letterhead, white bond, A4, and legal, respectively. Since the multiple trays 12, 14, 16 and 18 may be loaded with various types of paper, the user is relieved of the time consuming task of loading the printer with additional paper each time a different style of paper is desired.

To conserve space and to reduce the overall cost of the paper handling mechanism 10, the trays 12, 14, 16 and 18 are arranged vertically in close proximity to one another. A single paper-feeding mechanism 20 draws paper from all of the trays 12, 14, 16 and 18. Therefore, the paper-feeding mechanism 20 generally moves vertically to selectively engage each of the plurality of trays 12, 14, 16 and 18. As illustrated, an electric motor 22 generates power to move the paper-feeding mechanism 20 vertically.

Since the paper-feeding mechanism 20 moves vertically at one end of the trays 12, 14, 16 and 18, the trays 12, 14, 16 and 18 are preferably horizontally moveable between a rest position and a paper-feeding position. When the trays 12, 14, 16 and 18 are in the rest position, as illustrated, the paper-feeding mechanism 20 does not contact the paper within the trays as it moves vertically. However, when a selected tray 12, 14, 16 or 18 is moved into the paper-feeding position, as illustrated by the phantom lines corresponding to tray 16 in FIG. 1, the selected tray intersects the vertical path of the paper-feeding mechanism 20. When a tray 12, 14, 16 or 18 is in the paper-feeding position, the paper-feeding mechanism 20 can contact the stack of paper within the selected tray 12, 14, 16 or 18, and remove paper from the stack.

It should be appreciated that when the trays 12, 14, 16 and 18 are in the rest position, all of the trays 12, 14, 16 and 18 are readily available for receiving paper. The paper can either be additional paper of the same type, or small quantities of special paper specifically loaded for a special print request (i.e., transparencies for overheads, special size paper, special color paper, etc.). Loading the trays 12, 14, 16 and 18 is particularly simple because, unlike the prior devices, the paper-feeding mechanism 20 is not in contact with the stack of paper. Thus, owing to a lack of mechanical obstructions, the paper is directly loadable into the trays 12, 14, 16 and 18 from the rear of the mechanism 10.

Figure 2:
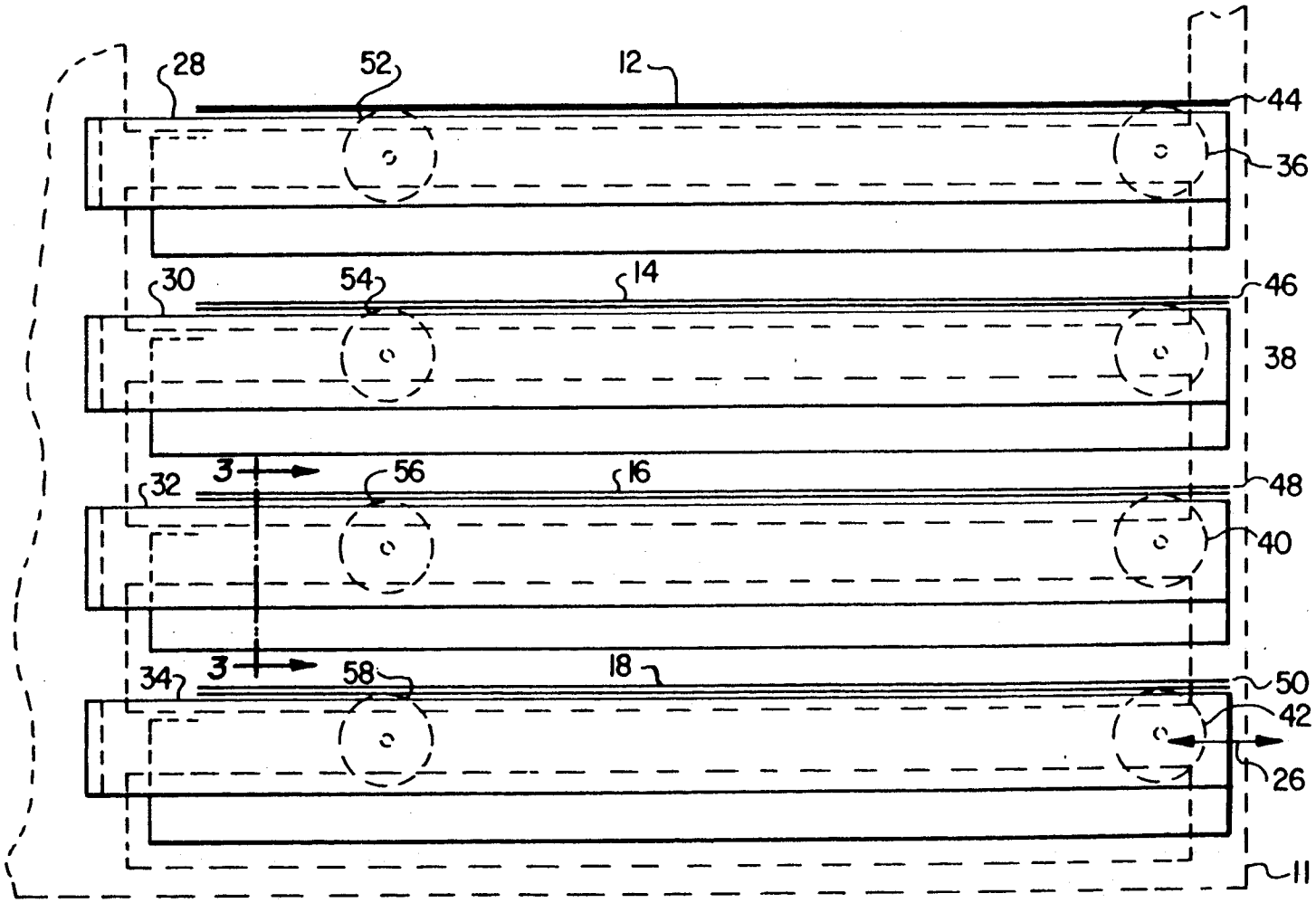
FIG. 2 is a side view of paper trays in accordance with the present invention.

FIG. 2 illustrates a preferred embodiment of the slidable trays 12, 14, 16 and 18. This view is taken from the side of the mechanism 10 opposite that illustrated in FIG. 1. The frame 11 is illustrated by the phantom lines that correspond to the reference numeral 11. The trays 12, 14, 16 and 18 are adapted to slide in the horizontal direction as designated by a double-headed arrow 26. Each of the trays 12, 14, 16 and 18 is slidably mounted on respective rails 28, 30, 32 and 34. A roller 36, 38, 40 and 42 is rotatably mounted one end of each of the respective rails 28, 30, 32 and 34 so that each roller 36, 38, 40 and 42 engages a corresponding upper, outwardly extending lip 44, 46, 48 and 50 provided on each of the respective trays 12, 14, 16 and 18. To support the end of each tray 12, 14, 16 and 18 that is opposite the rollers 36, 38, 40 and 42, rollers 52, 54, 56 and 58 are rotatably mounted at one end of each respective tray 12, 14, 16 and 18. The rollers 52, 54, 56 and 58 ride on a lower flange portion of the rails 28, 30, 32 and 34, respectively.

Figure 3:
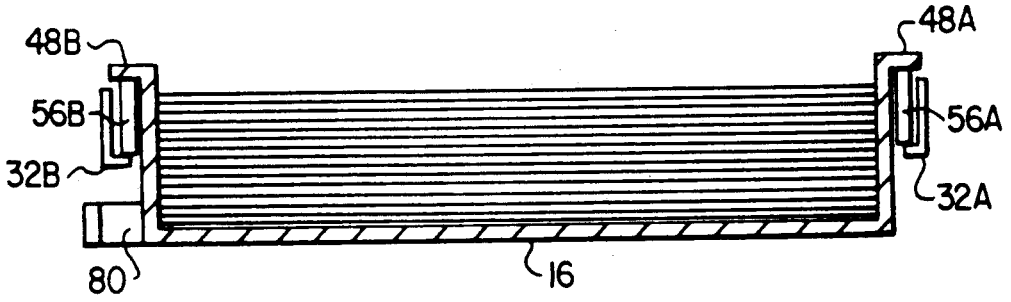
FIG. 3 is a cross-sectional view of a paper tray taken along line 3—3 in FIG. 2.

Preferably, each tray 12, 14, 16 and 18 is supported on two sides. As illustrated by the cross-sectional view of tray 16 in FIG. 3, each tray 12, 14, 16 and 18 includes two opposing lips 48A, 48B and two opposing rollers 56A, 56B, so that each tray 12, 14, 16 and 18 is supported by two rails 32A, 32B. The rails 28, 30, 32 and 34 on each side of the trays 12, 14, 16 and 18 are preferably mounted, e.g., by brackets (not shown), directly to the frame 11.

Referring again to FIG. 1, an electric motor 60 provides the mechanical power to selectively drive the trays 12, 14, 16 and 18 along the rails 28, 30, 32 and 34 between the rest and paper-feeding positions. The motor 60 is operably connected to a shaft 62 that extends vertically along one side of the trays 12, 14, 16 and 18. The motor 60 and the shaft 62 are mounted on a frame 64 that extends vertically along one side of the trays 12, 14, 16 and 18. The lower portion of the shaft 62 resides within a coupling 66 that is mounted on the lower portion of the frame 64. The coupling 66 permits the shaft 62 to rotate about its axis in response to rotation of the motor 60.

A plurality of gears 68, 70, 72 and 74 are fixed to the shaft 62 at various vertical locations to respectively coincide with racks 76, 78, 80 and 82 extending horizontally along the side of each of the trays 12, 14, 16, 18. Thus, rotation of the motor 60 in a first direction produces similar rotation in the shaft 62 and the gears 68, 70, 72 and 74. The gears 68, 70, 72 and 74 interact with their corresponding rack 76, 78, 80 and 82 and convert the rotational movement into horizontal linear movement of each of the trays 12, 14, 16, 18. It should be clear that rotation of the motor 60 in a first direction produces horizontal movement of the trays 12, 14, 16, 18 from the rest position to the paper-feeding position, while rotation of the motor 60 in a second direction moves the trays 12, 14, 16, 18 from the paper-feeding position to the rest position.

For the paper-feeding mechanism 20 to properly intersect with the trays 12, 14, 16, 18, the selected tray is preferably horizontally moved between the rest position and the paper-feeding position without corresponding movement of the unselected trays. For example, if the user desires to print on paper contained in the lowest tray 18, then not only should it move to the paper-feeding position, but the unselected trays 12, 14 and 16 should remain in the rest position. Otherwise, the trays 12, 14, 16 interfere with vertical movement of the paper feeding mechanism 20 and prevent the paper feeding mechanism 20 from descending to and contacting the paper contained in the lowest tray 18. It should be appreciated that similar problems arise when operation of intermediate trays 14 and 16 is desired.

Accordingly, the motor 60 and shaft 62 employ a transmission 84 to selectively engage or drive only one of the desired gears 68, 70, 72 or 74. One embodiment of such a transmission 84 is discussed in U.S. Pat. 5,044,620. This patent discloses, as a preferred embodiment, a shaft that carries gears having a preselected vertical spacing. The shaft not only rotates but also moves vertically to selectively engage one of the gears with the rack gear on a selected tray. Once engaged, the shaft rotates to horizontally move the selected tray to a paper-feeding position.

Another embodiment of a transmission 84 is discussed in U.S. Pat. No. 5,075,721. This patent discloses, as a preferred embodiment, a shaft that carries a plurality of sun gears that are vertically disposed adjacent a respective rack gear on the respective trays. Each sun gear is counter-rotatably connected to a planet gear by a respective link. When the shaft begins to rotate, the planet gears attempt to engage with their corresponding rack. However, a plurality of levers block the engagement of all of the planet gears except for the planet gear located adjacent the selected tray. Therefore, only a selected planet gear will engage with its corresponding rack gear and drive the tray to a paper-feeding position.

Figure 4:
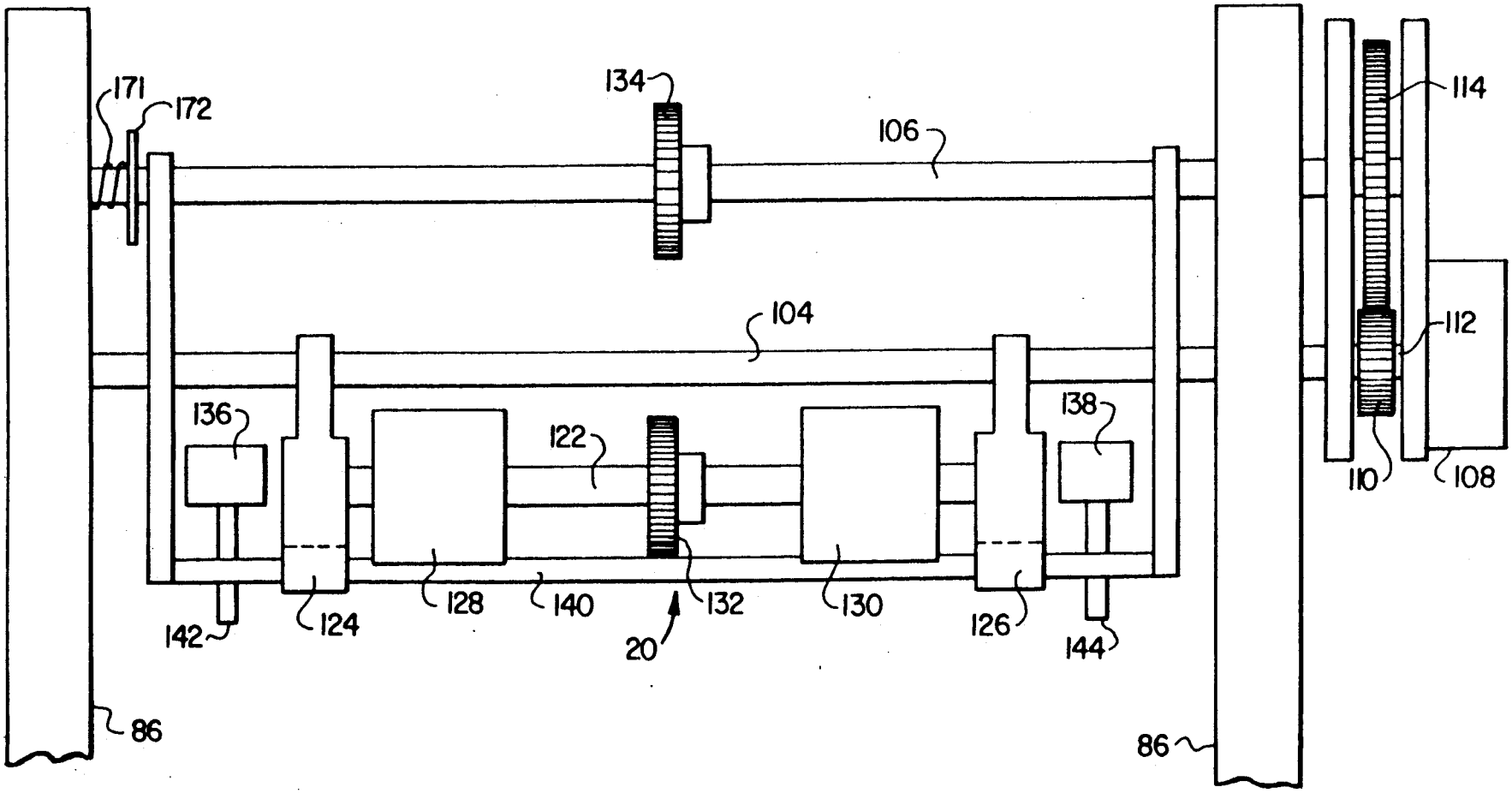
FIG. 4 is a from view of a sheet feeding apparatus in accordance with the present invention.
Figure 5:
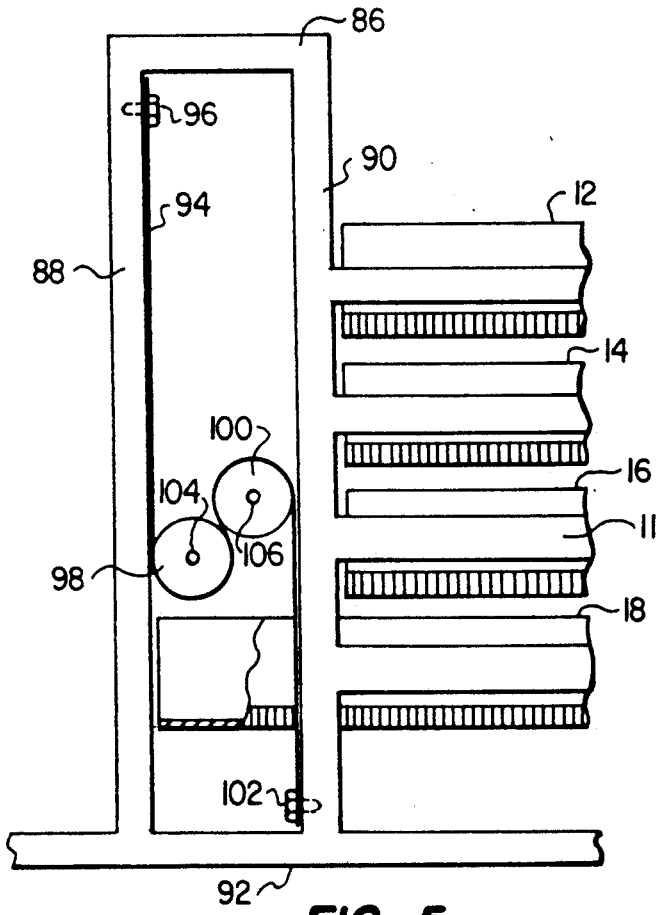
FIG. 5 is a side view of a roller assembly that moves the sheet feeding apparatus vertically.

FIG. 4 is a front view of a preferred paper-feeding mechanism 20. The paper-feeding mechanism 20 is disposed in the frame 11 within a vertical frame assembly 86. The paper-feeding mechanism 20 is adapted to move generally vertically along the vertical frame assembly 86 to intersect and remove paper from a selected tray. To fully appreciate the features of the preferred embodiment of the paper-feeding mechanism 20, the vertical frame assembly 86 and the movement of the paper-feeding mechanism 20 within it will be described first, and the operation of the paper-feeding mechanism 20 as it removes paper from a selected tray 12, 14, 16 or 18 will be described subsequently.

Figure 6:
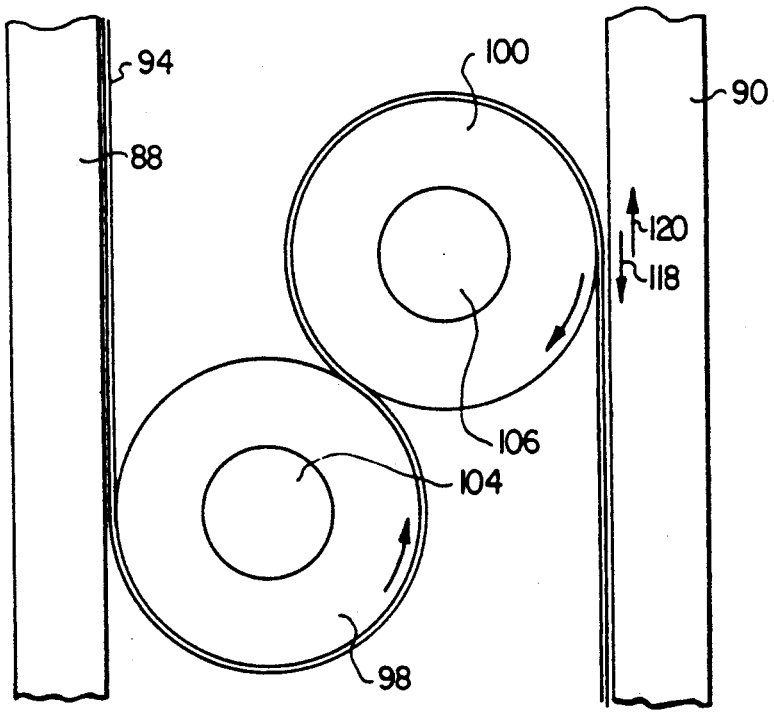
FIG. 6 is an enlarged side view of FIG. 6.

As shown in FIG. 6, the vertical frame assembly 86 includes a pair of rails 88 and 90 extending generally vertically from a base 92 and spaced a preselected substantially constant distance apart. A strip of spring steel 94 is attached to an upper interior surface of the rail 88 by a screw 96, extends downward along the interior surface of the rail 88 and around the lower circumference of a first roller 98, returns upward over the upper circumference of a second roller 100, and extends downward along the interior surface of the rail 90 where it is connected to the interior surface of the rail 90 by a screw 102. With this arrangement, rotation of the upper roller 100 in the clockwise and counterclockwise directions respectively produces upward and downward movement of the rollers 98 and 100, as is discussed more fully in connection with the description of FIG. 7.

The rollers 98 and 100 each have a shaft 104 and 106, respectively, passing coaxially therethrough and extending through a second pair of rollers (not shown) which are captured between a substantially identical pair of rails and strip of spring steel positioned a sufficient distance away to allow paper trays 12, 14, 16 and 18 to be disposed therebetween. An electric motor 108 is adapted to rotate the shaft 106.

The motor 108 drives a gear 110 which is connected to the output shaft 112 of the motor 108. The gear 110 rotatably engages with a larger gear 114 which is attached to the shaft 106. Therefore, the shaft 106 rotates slower than the output shaft 112 of the motor 108. The motor 108 may be any of a variety of standard types of electric motors, but preferably is a stepper motor. Operation of the motor 108 is effected by a controller 116 that is preferably microprocessor based, but can also be any of a variety of hardwired controllers.

Figure 7:
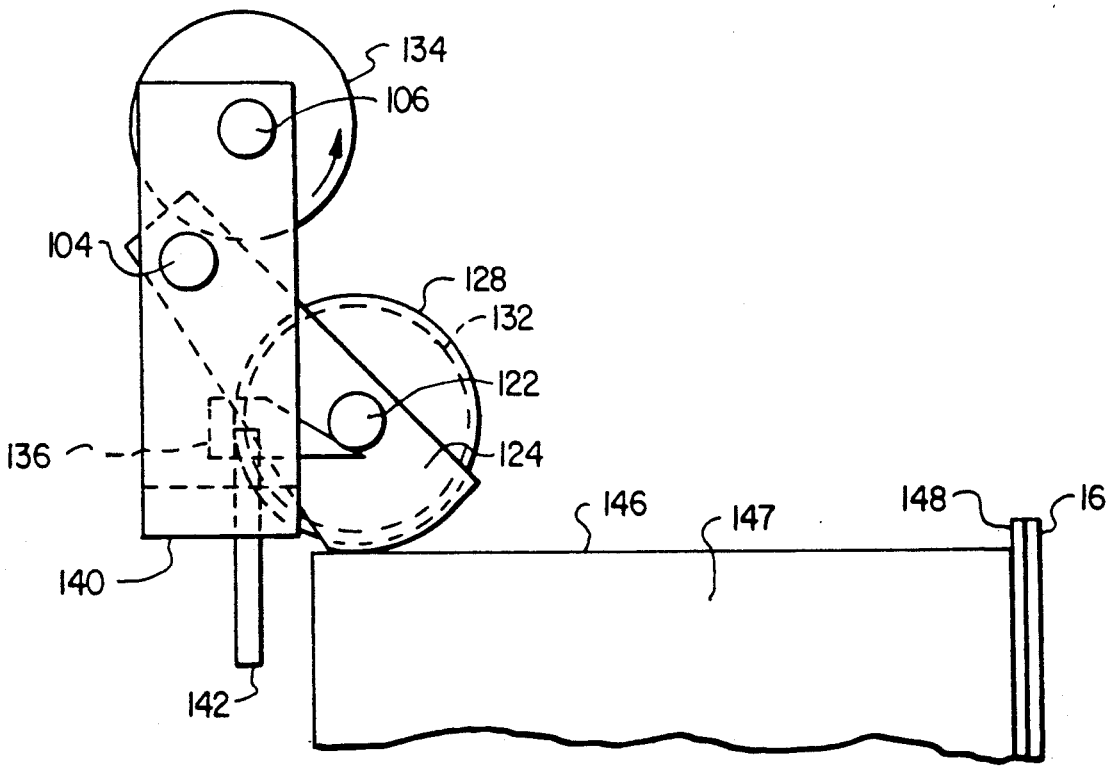
FIG. 7 is an enlarged side view of the sheet feeding apparatus of FIG. 4, moving downwardly to contact a stack of paper.

Referring to FIG. 7, operation of the roller assembly is described in greater detail. To the extent possible, elements illustrated in FIG. 7 that are common to the elements in FIG. 6 are assigned common element numbers to enhance the identity of elements and to aid in the understanding of their operation.

The rails 88 and 90 are spaced a preselected distance apart, which is relatively insignificant except that the diameters of the rollers 98 and 100 are preferably substantially similar and each should be greater than one-half the preselected distance between the interior surfaces of the rails 88 and 90. Otherwise, the upper roller 100 would be unsupported and free to fall downward. The spring steel 94 extending around the lower circumference of the lower roller 98 supports that roller, while the upper roller 100 is captured between the lower roller 98 and the rail 90.

Operation of the rollers 98 and 100 is more easily comprehended if the rollers 98 and 100 are analogized to the wheels of an automobile and the spring steel 94 is viewed as the road surface on which the automobile travels. Consider, for example, vertically upward movement of the rollers 98 and 100. The upper roller 100 is rotated in the clockwise direction, producing a force tangential to the roller surface and parallel to the surface of the rail 90, as represented by arrow 118. Assuming that this tangential force is sufficient to overcome any forces in the opposite direction, i.e. gravity, friction, etc., then the roller 100 moves vertically upwardly along the spring steel 94, much like the tire of an automobile moving along the road surface.

Alternatively, relative to the roller 100, the strip of spring steel 94 can be considered to be moving clockwise around the circumference of the upper roller 100. Therefore, the strip of spring steel 94 must also be moving counterclockwise around the lower roller 98. Thus, by configuring the lower roller 98 to be an idler that is not driven by the motor 108 but is allowed to be rotated in the counterclockwise direction by movement of the spring steel 94, the pair of rollers 98 and 100 moves upwardly in response to the motor 108 driving the upper roller 100 in the clockwise direction.

Consider now, for example, vertically downward movement of the rollers 98 and 100. The roller 100 is rotated in the counterclockwise direction, producing a force tangential to the roller surface and parallel to the surface of the rail 90, as represented by arrow 120. Assuming that this tangential force along with the force exerted by gravity is sufficient to overcome any forces in the opposite direction, i.e. friction, etc., then the roller 100 moves vertically downwardly along the spring steel 94, much like the tire of an automobile moving along the road surface.

Alternatively, relative to the roller 100, the strip of spring steel 94 can be considered to be moving counterclockwise around the circumference of the roller 100. Therefore, the strip of spring steel 94 must also be moving clockwise around the lower roller 98. Thus, by configuring the lower roller 98 to be an idler that is not driven by the motor 108, but is allowed to be rotated in the clockwise direction by movement of the spring steel 94, the pair of rollers 98 and 100 moves downwardly in response to the motor 108 driving the upper roller 100 in the counterclockwise direction.

Ordinarily, the weight of the rollers 98 and 100 is sufficient to induce rotation of the rollers 98 and 100 in the clockwise and counterclockwise directions, respectively. This, of course, results in downward movement of the rollers 98 and 100. Thus, absent some device to prevent unrestricted rotation of the rollers 98 and 100, they are predisposed to movement to the lowest possible vertical position. Therefore, the motor 108 is preferably a stepper motor, which resists rotation unless specifically commanded to rotate by the controller 116. That is to say, the stepper motor 108 acts to maintain its rotational position unless specifically commanded to alter its rotational position. The mechanical gear connection between the motor 108 and the upper roller 100 insures that the roller 100 is not free to rotate in an uncontrolled manner in the counterclockwise direction.

Referring again to FIG. 4 the paper-feeding mechanism 20 includes a shaft 122 that is pivotally connected to the shaft 104 by a pair of feet 124 and 126. The shaft 122, in turn, is rotatably connected to the feet 124 and 126. Preferably, the shaft 104 and each end of the shaft 122 reside in bushings (not shown) which are disposed in the feet 124 and 126 to provide smooth rotatable motion. Preferably, each of the feet 124 and 126 are made of plastic or other material which has a sufficiently low durometer to ensure substantial friction between the feet 124 and 126 and the top sheet of paper in a selected stack. Alternatively, each of the feet 124 and 126 may include a pad (not shown) on the bottom portion thereof which has a sufficiently low durometer to ensure substantial friction between the pad and the top sheet of paper in the selected stack. The reasons for this friction will become apparent in reference to the discussion accompanying FIGS. 8–10.

The shaft 122 carries a pair of rubber-like wheels 128 and 130. The wheels 128 and 130 are fixedly attached to the shaft 122 for rotation therewith. Again, at least the outer portion of the wheels are made from a material having a sufficiently low durometer to ensure substantial friction between the wheels 128 and 130 and the top sheet of paper in the selected stack. The shaft 122 also carries a gear 132 which is adapted to selectively engage a gear 134 that is carried on the drive shaft 106. When the gear 132 engages with the drive gear 134, the drive gear 134 imparts rotational motion to the gear 132, and, thus, rotates the wheels 128 and 130. The gears 132 and 134 engage When the shaft 122 pivots upwardly about shaft 104 in response to the paper-feeding mechanism 20 lowering and the feet 124 and 126 contacting the top sheet of paper in a selected stack.

The paper-feeding mechanism 20 further includes a pair of ramp-like members 136 and 138. The ramp-like members 136 and 138 are connected to the bottom portion of a support structure 140 via adjustable legs 142 and 144, respectively. The structure and function of the ramp-like members 136 and 138 will be discussed in greater detail with respect to FIG. 9.

Figure 8:
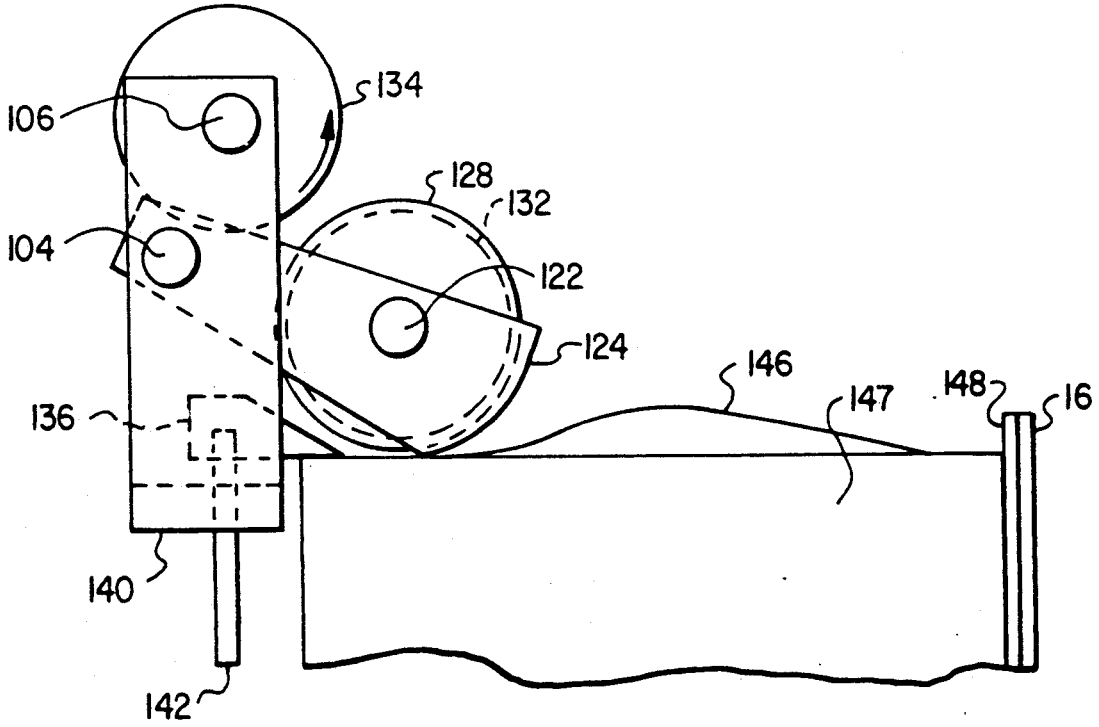
FIG. 8 is an enlarged side view of the sheet feeding apparatus of FIG. 4, in the process of bowing the top sheet of the stack of paper.

The operation of the paper-feeding mechanism 20 will now be described with reference to FIGS. 8–10. In response to a print request, the roller assembly, described with reference to FIGS. 6 and 7, moves the paper-feeding mechanism 20 from a rest position near the top of the frame 86 vertically downward to contact the top sheet in a selected stack of paper 147. Whether the paper-feeding mechanism 20 moves continuously downward, or whether it pauses before contacting the paper, depends upon the type of transmission 84 used. Of course, the movement of the paper-feeding mechanism 20 is controlled by the controller 116, as described in the aforementioned co-pending applications. Regardless, as the paper-feeding mechanism 20 moves downwardly, the feet 124 and 126 initially contact the top sheet of paper in a selected tray 12, 14, 16 or 18. Since the friction between the feet 124 and 126 and the top sheet of paper is substantially greater than the friction between the top sheet of paper and the next lower sheet of paper, the feet 124 and 126 push the top sheet of paper rearwardly in the tray.

Figure 11:
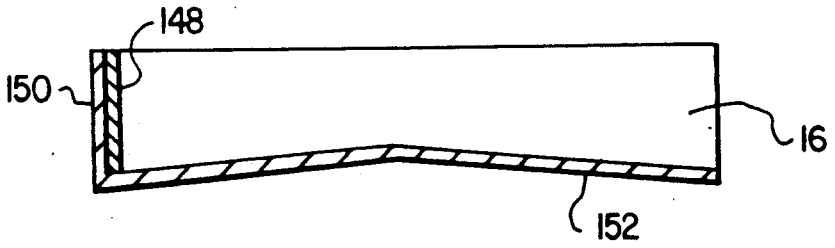
FIG. 11 is a cross-sectional view of the tray of FIG. 11 taken along line 10—10 in FIG. 10.

Referring briefly to FIG. 11 and using tray 16 as an example, a pad 148 is affixed to the rear wall 150 of the tray 16. The pad 148 facilitates the separation of the top sheet of paper 146 from the rest of the stack. Preferably, the pad 148 is made from a fibrous material where the fibers extend outwardly toward the paper and are disposed generally parallel to the sheets of paper. Advantageously, nylon fibers of approximately ⅛ inches in length are used. As the top sheet of paper starts moving rearwardly it penetrates between the fibers in the pad 148. Since the top sheet 146 is moving, the friction between it and the lower sheets is dynamic friction rather than static friction. Since dynamic friction is lower than static friction with the same normal force, the pad 148 ensures that the top sheet 146 separates from the remainder of the stack. The remainder of the stack compresses the fiber pad 148, but does not penetrate between the fibers.

Figure 9:
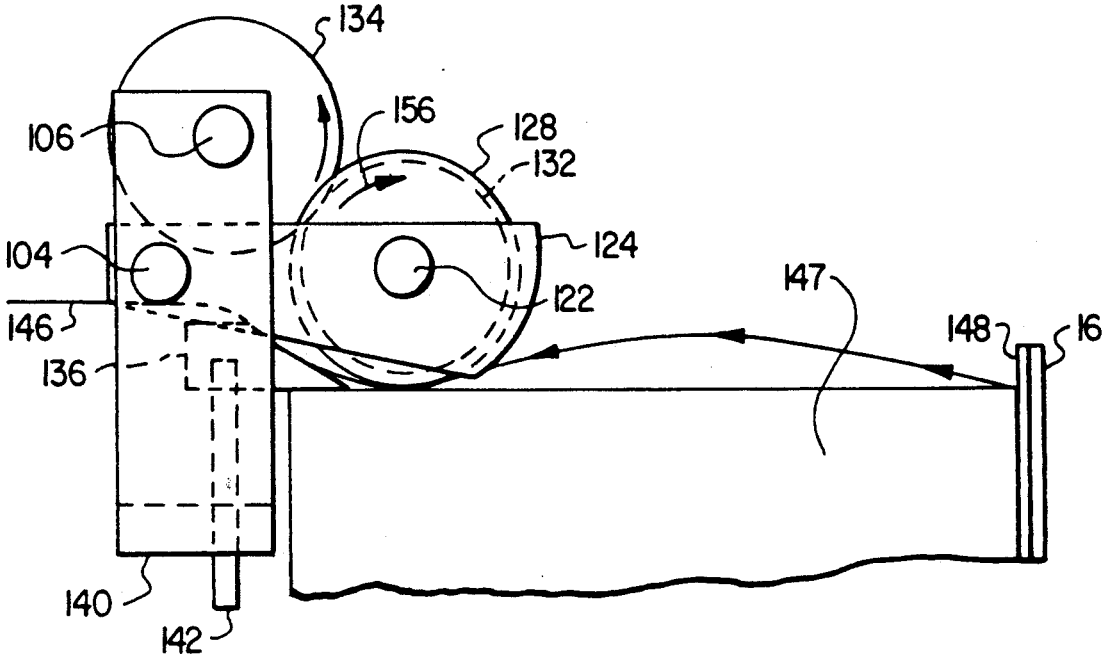
FIG. 9 is an enlarged side view of the sheet feeding apparatus of FIG. 4, in the process of removing the top sheet of paper from the stack of paper.

As illustrated in FIG. 9, after the feet 124 and 126 have contacted the top sheet of paper in the selected tray 12, 14, 16 or 18, the paper-feeding mechanism 20 continues to move downwardly while the feet 124 and 126 begin to pivot upwardly. As a result, the top sheet of paper 146 separates from the lower sheets of paper and bows upwardly.

Figure 12:
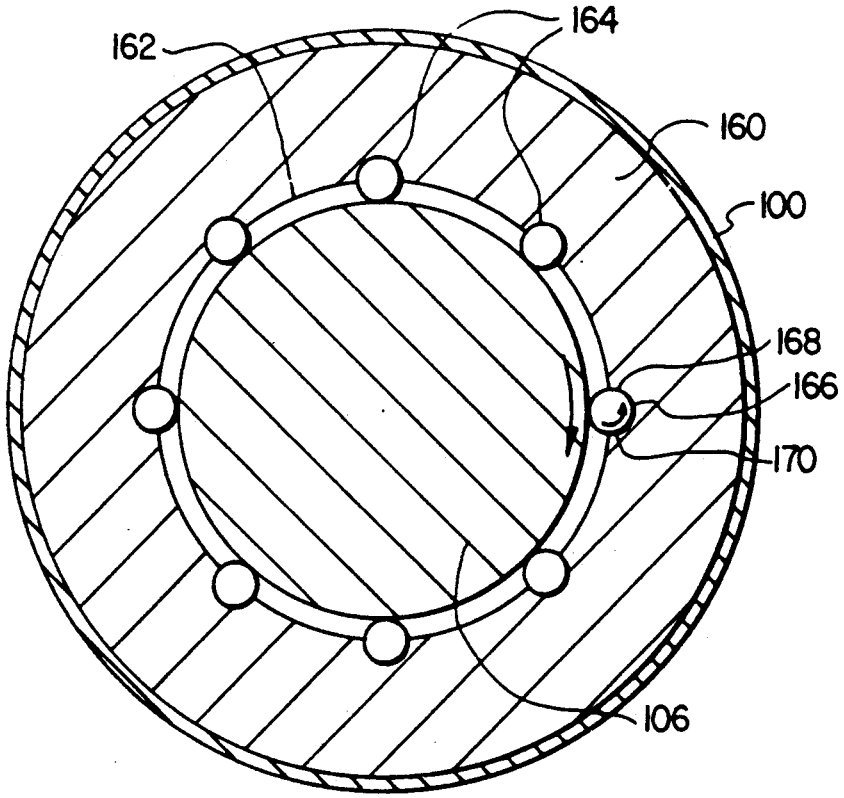
FIG. 12 is a cross-sectional view of a one-way clutch assembly.

Referring briefly to FIG. 12, a cross-sectional view of tray 16 is illustrated. The bottom 152 of tray 16 is slightly bowed. The bottom of 152 of tray 16 rises from the rear wall 150 until it reaches about the center of tray 16, and then falls until it reaches the front of tray 16. The bowed bottom portion of the trays 12, 14, 16 and 18, as illustrated with respect to tray 16 in FIG. 12, pre-bows the stack of paper which is disposed in each tray 12, 14, 16 and 18. Therefore, when the feet 124 and 126 contact the top sheet 146, the top sheet 146 is predisposed to bow upwardly, and, thus, separates from the rest of the stack more easily.

Referring again to FIG. 9, once the front portion of the top sheet of paper 146 is moved rearwardly, the ramp-like members 136 and 138 contact the second sheet of paper at the edge of the stack. Preferably, the ramp-like members 136 and 138 are made of a flexible material, such as a thin, bent strip of metal, so that as the paper-feeding mechanism 20 continues to move downwardly, the ramp-like members 136 and 138 deform slightly to allow for such movement and to maintain downward pressure on the stack of paper. Alternatively, a spring (not shown) may be disposed around each of the legs 142 and 144. As the paper-feeding mechanism 20 moves downwardly, the springs compress to avoid deformation of the ramp-like member 136 and 138 and to avoid damaging the edge of the stack of paper.

Figure 10:
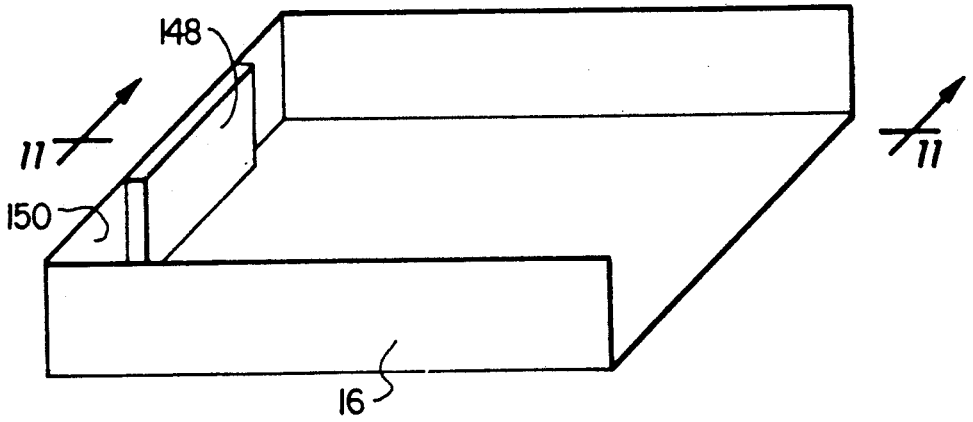
FIG. 10 is a perspective view of a tray in accordance with the present invention.

Referring now to FIG. 10, as the paper-feeding mechanism 20 continues moving downwardly, the driven gear 132 engages with the drive gear 134. Since the drive gear 134 is rotating on the shaft 106, this engagement causes the driven gear 132 to counter-rotate with respect with to the gear 134. Thus, the wheels 128 and 130 begin to rotate in the direction of the arrow 156. Since the feet 124 and 126 have pivoted upwardly so that they are no longer contacting the top sheet of paper 146, the rotating wheels 128 and 130 engage the top sheet of paper 146, and propel the top sheet of paper 146 over the ramp-like members 136 and 138 and into the printing mechanism (not shown).

Once the ramp-like members 136 and 138 contact the stack of paper and once the feet 124 and 126 move out of contact with the stack of paper, the continued rotation of the shaft 106 does not further propel the paper-feeding mechanism 20 downwardly. A one-way clutch is disposed in the driven roller 100 on each side of the paper-feeding mechanism 20. The one-way clutches are configured to provide relative rotational movement between the driven shaft 106 and the rollers 100 when the shaft 106 is driven in the counterclockwise direction to move the paper-feeding mechanism 20 downwardly. However, the one-way clutches do not allow relative rotational movement between the shaft 106 and the rollers 100 when t he shaft 106 is driven in the clockwise direction to raise the paper-feeding mechanism 20.

Referring now to FIG. 13, a cross-sectional view of a one-way clutch 160, the roller 100, and the shaft 106 is illustrated to more fully describe the operation of the one-way clutches. Preferably, the one-way clutch 160 is commercially available from Winfred M. Berg, Inc., located at 499 Ocean Avenue, East Rockaway, N.Y. 11518, as part number NRC-4.

The one-way clutch 160 is coaxially disposed in the center of the roller 100. Preferably, the one-way clutch 160 is press fitted into a cylindrical opening in the center of the roller 100. The one-way clutch 160 includes a central bore 162 that extend coaxially through the one-way clutch 160 generally in alignment with the axis of the shaft 106. The central bore 162 receives an end of the shaft 106 and supports the shaft 106 via a series of cylindrical roller bearings 164. The roller bearings 164 are uniformly disposed about the periphery of the bore 162.

To provide the one-way clutching action, the roller bearings 164 are contained within asymmetrical chambers 166. The chambers 166 are divided into first and second longitudinal halves 168 and 170. The first longitudinal half 168 has an arcuate cross-sectional configuration with a radius substantially similar to the radius of the roller bearing 164. The second longitudinal half 170 is tapered in a direction extending away from the roller bearing 164. When the shaft 106 rotates in a counterclockwise direction, the roller bearings 164 are forced to rotate in the clockwise direction as a result of contact with the shaft 106. Since the roller bearings 164 are forced against the matching arcuate of the first longitudinal half 168, the roller bearings 164 are free to rotate, thereby permitting the shaft 106 to rotate relative to the one-way clutch 160.

However, when the shaft 106 rotates in a clockwise direction, the roller bearings 164 are forced to attempt to rotate in a counterclockwise direction as a result of contact with the shaft 106. Since the roller bearings 164 are forced against the tapered surface of the second longitudinal half 170, the roller bearings become pinched by the tapered surface, and, therefore, are prevented from rotating in the counterclockwise direction. Since the roller bearings 164 cannot rotate in the counterclockwise direction, the shaft 106 cannot rotate relative to the one-way clutch 160. Instead, the shaft 106 rotates the one-way clutch 160, and, thus, the roller 100, in the clockwise direction.

When the shaft 106 rotates in the counterclockwise direction, the one-way clutch 160 rotates relative to the shaft 106, and the weight of the paper-feeding mechanism 20 will cause the paper-feeding mechanism 20 to move downwardly. Conversely, when the shaft 106 rotates in the clockwise direction, the roller 100 rotates therewith, and, thus, drives the paper-feeding mechanism 20 upwardly.

Rather than relying on the weight of the paper-feeding mechanism 20 for downward motion, the paper-feeding mechanism 20 may be driven downwardly. To drive the paper-feeding mechanism 20 downwardly, rather than relying on its own weight to move it downwardly, a spring 171 is fixedly attached at one end to the shaft 106. The other end of the spring 171 is forced against the body of one of the one-way clutches 160 or against the side of the roller 100. Preferably, a flange or washer 172 is fixedly connected to the shaft 106 to maintain the spring 171 in compression against the one-way clutch 160. Therefore, as the shaft 106 rotates in the counter clockwise direction, the frictional force of the spring 171 against the one-way clutch 160 causes the one-way clutch 160 and the roller 100 to rotate with the shaft 106. However, when the paper-feeding mechanism 20 contacts the stack of paper in the selected tray 12, 14, 16 or 18, the frictional force of the spring 171 is overcome, and the shaft 106 rotates relative to the one-way clutch 60 and the roller 100.

Therefore, it should be appreciated that rotation of the motor 108 in a first direction drives the paper-feeding mechanism downwardly, and rotation of the motor 108 in a second direction drives the paper-feeding mechanism 20 upwardly. Since the one-way clutches 160 allow the paper-feeding mechanism 20 to cease moving downwardly after it makes substantial contact with the selected stack, continued rotation of the motor 108 provides rotational power to the wheels 128 and 130 which feed individual sheets of paper into the printer.

To remove additional sheets of paper from a selected stack, the controller 116 signals the motor 108 to reverse and raise the paper-feeding mechanism 20 out of contact with the selected stack. The controller 116 then signals the motor 108 to again lower the paper-feeding mechanism 20 onto the stack to repeat the process described with respect to FIGS. 8–10.

While a specific preferred embodiment has been described, other embodiments may work as well. For instance, the feet 124 and 126 may be disposed so as not to contact the stack of paper, but merely be used for pivoting the shaft 122 relative to the shaft 106. The shaft 122 is be rotatably connected to the feet 124 and 126 via bushings, as previously described. A spring may be disposed between a washer fixed to the shaft 122 and the bushing, similar to the spring 171 and washer 172, to impede rotation of the shaft 122. When the paper-feeding mechanism 20 lowers, the wheels 128 and 130 Would contact the top sheet on the selected stack. The force of this contact would not be sufficient to overcome the force of the spring, so the shaft 122 would not rotate. Therefore, the wheels 128 and 130 would urge the top sheet toward the rear wall of the selected tray. Once the gear 132 pivots into engagement with the gear 134, the force of the motor 108 is enough to overcome the force of the spring. Therefore, the wheels 128 and 130 rotate to remove the top sheet of paper from the stack.

I claim:

1. A mechanism for removing a sheet from a stack of sheets comprising:

means for moving a selected sheet in a first direction to separate said said selected sheet from the stack, said means for moving including a foot being adapted to pivot upward in response to said foot contacting said selected sheet as said mechanism moves downward along a preselected vertical path, said foot being adapted to move said selected sheet in said first direction as said foot pivots;

means for preventing movement of unselected sheets within the stack; and means for removing said selected sheet from the stack by moving said selected sheet in a second direction different from said first direction.

2. The mechanism, as set forth in claim 1, wherein said preventing means comprises:

a ramp-like member being disposed on said mechanism and adapted to contact and thereby restrain movement of said stack of sheets.

3. The mechanism, as set forth in claim 1, wherein said removing means comprises:

a rotatable wheel being disposed to contact said selected sheet and remove said selected sheet from said stack of sheets in response to selective rotation of said wheel.

4. A sheet-feeding mechanism for removing a sheet from a stack of sheets, said mechanism being adapted to move along a preselected vertical path, said mechanism comprising:

a drive shaft having a longitudinal axis and being adapted to rotate about its longitudinal axis;

a drive gear disposed on said drive shaft for rotation therewith;

a driven shaft having a longitudinal axis and being adapted to rotate about its longitudinal axis;

a driven gear disposed on said driven shaft for rotation therewith;

means for allowing said driven shaft to pivot relative to said drive shaft between a first position wherein said drive gear is not engaged with said driven gear and a second position wherein said drive gear is engaged with said driven gear to transfer rotational motion thereto;

means for moving a selected sheet on the stack in a first direction to separate said selected sheet from the stack in response to said mechanism moving-downward along said path and in response to said driven shaft pivoting upwardly toward said second position;

means for preventing movement of unselected sheets of paper within the stack; and a wheel being disposed on said driven shaft and being adapted to rotate therewith, said wheel being disposed to contact said selected sheet and remove said selected sheet from said stack of sheets in response to said driven shaft pivoting to said second position.

5. The mechanism, as set forth in claim 4, further comprising:

means for rotating said drive shaft.

6. The mechanism, as set forth in claim 5, wherein said allowing means comprises:

a pivot shaft having a longitudinal axis and being disposed substantially parallel to the longitudinal axes of said drive shaft and said driven shaft;

a pivotal link having a first end and a second end, said first end being pivotally connected to said pivot shaft, said driven shaft being rotatably connected to said second end and being pivotal about said first end relative to said drive shaft between an undriven position and a driven position, said driven gear being disposed on said driven shaft to engage with said drive gear when said driven shaft pivots from said undriven position to said driven position.

7. The mechanism, as set forth in claim 4, wherein said moving means comprises:

a foot being adapted to pivot said driven shaft relative to said drive shaft between an undriven position and a driven position, said driven shaft being rotatably connected to said foot and said driven gear being disposed on said driven shaft to engage with said drive gear when said driven shaft pivots from said undriven position to said driven position, said foot being adapted to contact said selected sheet when said stack is positioned in said vertical path as said mechanism moves vertically downward toward said stack of sheets, said contact causing said foot to pivot said driven shaft from said undriven position toward said driven position and move said selected sheet in said first direction.

8. The mechanism, as set forth in claim 4, wherein said preventing means comprises:

a ramp-like member being disposed on said mechanism and adapted to contact and thereby restrain movement of said stack of sheets.

9. A sheet-feeding mechanism for removing a sheet from a stack of sheets, said mechanism being adapted to move along a preselected vertical path, said mechanism comprising:

a drive shaft having a longitudinal axis and being adapted to rotate about its longitudinal axis;

a drive gear disposed on said drive shaft for rotation therewith;

a driven shaft having a longitudinal axis and being adapted to rotate about its longitudinal axis;

a driven gear disposed on said driven shaft for rotation therewith;

a foot being adapted to pivot said driven shaft relative to said drive shaft between an undriven position and a driven position, said driven shaft being rotatably connected to said foot and said driven gear being disposed on said driven shaft to engage with said drive gear when said driven shaft pivots from said undriven position to said driven position, said foot being adapted to contact a top sheet in a stack of sheets positioned in said vertical path as said mechanism moves vertically downward toward said stack of sheets, said contact causing said foot to pivot said driven shaft from said undriven position toward said driven position and separate said top sheet from said stack of sheets;

a wheel being disposed on said driven shaft and being adapted to rotate therewith, said wheel being disposed relative to said foot to contact said top sheet as the foot pivots out of contact with said top sheet in response to said driven shaft pivoting to said driven position, whereby resulting rotation of said wheel removes said top sheet from said stack of sheets.

10. A sheet-feeding mechanism for removing a sheet from a stack of sheets, said mechanism being adapted to move along a preselected vertical path, said mechanism comprising:

a drive shaft having a longitudinal axis and being adapted to rotate about its longitudinal axis;

a drive gear disposed on said drive shaft for rotation therewith;

means for rotating said drive shaft;

a driven shaft having a longitudinal axis and being adapted to rotate about its longitudinal axis;

a driven gear disposed on said driven shaft for rotation therewith;

a pivot shaft having a longitudinal axis and being disposed substantially parallel to the longitudinal axes of said drive shaft and said driven shaft;

a foot having a first end and a second end, said first end being pivotally connected to said pivot shaft, said driven shaft being rotatably connected to said second end and being pivotal about said first end relative to said drive shaft between an undriven position and a driven position, said driven gear being disposed on said driven shaft to engage with said drive gear when said driven shaft pivots from said undriven position to said driven position, said foot being adapted to contact a top sheet in said stack of sheets as said mechanism moves vertically downward toward said stack of sheets, said contact causing said foot to pivot said driven shaft from said undriven position toward said driven position and to separate said top sheet from said stack of sheets;

a ramp-like member being disposed on said mechanism and adapted to contact and thereby restrain movement of said stack of sheets after said foot separates said top sheet from said stack of sheets; and a wheel being disposed on said driven shaft and being adapted to rotate therewith, said wheel being disposed relative to said foot to contact said top sheet as the foot pivots out of contact with said top sheet as said foot pivots said driven shaft to said driven position, whereby resulting rotation of said wheel propels said top sheet over said ramp-like member to remove said top sheet from said stack of sheets.

11. A method of removing a selected sheet from a stack of sheets, said method comprising the steps of:

moving a sheet feeding mechanism linearly toward the selected sheet in a first direction transverse thereto, said sheet feeding mechanism having a foot portion and a drive wheel portion linked for conjoint pivotal motion about an axis generally parallel to the selected sheet and generally transverse to said first direction;

contacting the selected sheet with the linearly moving foot portion, during continuing movement of said sheet feeding mechanism in said first direction, in a manner causing said foot portion to sequentially:

pivot about said axis while engaging the selected sheet and frictionally shifting it relative to the rest of the sheets in a second direction generally transverse to said axis and said first direction, and then pivot out of engagement with the shifted sheet and bring said drive wheel into frictional engagement with the shifted sheet; and initiating rotation of said drive wheel, subsequent to disengagement of said foot portion from the shifted sheet, to frictionally drive the shifted sheet relative to the rest of the sheets in a third direction opposite to said second direction.

12. The method of claim 11 wherein:

said step of initiating rotation of said drive wheel is automatically performed in response to pivotal disengagement of said foot portion from the shifted sheet.

13. The method of claim 12 wherein:

said sheet feeding mechanism includes a first gear, means for rotationally driving said first gear, and a second gear supported for conjoint pivotal movement with said foot portion and rotationally coupled to said drive wheel, and said step of initiating rotation of said drive wheel is performed by causing said first and second gears to drivingly mesh in response to pivotal disengagement of said foot portion from the shifted sheet.

14. The method of claim 11 further comprising the step of:

causing the selected sheet to bend outwardly away from the rest of the sheets in response to the shifting of the selected sheet by said foot portion.

15. The method of claim 11 further comprising the step of bending the stack of sheets prior to performing said moving step.

16. Sheet feeding apparatus for removing the top sheet of paper from a paper sheet stack supported in an open-topped, horizontally oriented tray, said apparatus being supported for selective movement downwardly toward the top sheet and comprising:

foot means supported for pivotal motion about a horizontal axis and having an outer end portion operative to engage the top sheet and frictionally shift it in a first horizontal direction relative to the rest of the sheets in the stack while being pivoted upwardly by the paper sheet stack during downward movement of said sheet feeding apparatus;

drive wheel means supported for conjoint pivotal movement with said foot means about said axis and operative to be brought into frictional engagement with the shifted top sheet, in response to a predetermined amount of upward pivoting of said foot means, in place of said outer end portion of said foot means; and means for rotating said drive wheel to drive the shifted top sheet frictionally engaged thereby in a second horizontal direction perpendicular to said first horizontal direction.

17. The sheet feeding apparatus of claim 16 wherein:

said means for rotating said drive wheel are operative in response to a predetermined amount of upward pivoting of said outer end portion of said foot means by the paper stack.

18. The sheet feeding apparatus of claim 17 wherein:

said apparatus includes a rotatably supported first gear, means for rotationally driving said first gear, and a second rotatable gear supported for conjoint pivotal motion with said foot means and rotationally locked to said drive sheel means, and said means for rotating said drive wheel means include means for causing said second gear to be upwardly pivoted into meshed engagement with said second gear by said foot means.

* * * * *